US005413022A

United States Patent [19]

Sleishman

[11] Patent Number: 5,413,022

[45] Date of Patent: May 9, 1995

[54] DRUM WITH FREE FLOATING TENSION ASSEMBLY

[76] Inventor: Donald E. Sleishman, Unit 11, 127-129 Newbridge Road, Chipping Norton, New South Wales, 2170, Australia

[21] Appl. No.: 35,160

[22] Filed: Mar. 22, 1993

[30] Foreign Application Priority Data

Mar. 27, 1992 [AU] Australia ..... PL1574

[51] Int. Cl.[6] ..... G10D 13/02

[52] U.S. Cl. ..... 84/413

[58] Field of Search ..... 84/413, 411 R, 411 A, 84/419, 420, 412

[56] References Cited

U.S. PATENT DOCUMENTS 4,295,405 10/1981 Sleishman ..... 84/413

4,869,146 9/1989 Bonsor ..... 84/413

4,928,566 5/1990 Yanagisawa ..... 84/413

*Primary Examiner*—M. L. Gellner

*Assistant Examiner*—Cassandra C. Spyrou

*Attorney, Agent, or Firm*—Collier, Shannon, Rill & Scott

[57] ABSTRACT

A drum comprising a shell, a pair of skins (12) disposed at opposite ends of the shell, and substantially free floating tensioning assembly (30) to stretch the skins over the respective ends of the shell. The tensioning assembly comprises respective engagement means adapted to grip the periphery of each skin, a stabilizing ring (32) extending around the shell intermediate its ends, and a plurality of adjustable peripherally spaced tensioning elements (35) extending intermediate the respective engagement means and the stabilizing ring. The tensioning assembly is disposed to transfer tension directly between the skins substantially independently of the shell, thereby facilitating tuning and permitting substantially undamped vibration of the shell.

6 Claims, 3 Drawing Sheets

DRUM WITH FREE FLOATING TENSION ASSEMBLY

The present invention relates to drums of the type used by musicians.

Such drums essentially comprise an open ended generally cylindrical shell and a diaphragm or skin stretched over each end of the shell. A relatively rigid rim is usually secured to the peripheral edge of each skin and a clamping ring structure in turn engages each rim to secure the skins in place over the shell. The clamping ring is generally loaded in the axial direction of the shell by means of a plurality of adjustable tensioning screws or "keys" extending between the clamping ring and a corresponding series of anchoring lugs fixed to the outside of the shell.

Typically, the anchoring lugs comprise metal blocks bolted securely to the shell intermediate its ends. In relatively shallow drums such as snare drums, there may be a single row of double-ended anchorage lugs disposed at mid height around the shell, with respective tensioning screws or keys extending in both directions from each lug to the corresponding clamping rings. In deeper drums, it is more common to provide two rows of anchoring lugs, each associated with a respective skin.

This arrangement permits independent adjustment of the tension in each skin, whereby the drum can be tuned. It is quite common, therefore, for the tension in the skins to be different from each another and consequently, the axial loads in the tensioning screws associated with the respective skins do not generally counterbalance one another. As a result, the unbalanced tensioning forces must be supported by the drum shell and so the anchorage lugs must be securely attached to the shell, even in those instances in which a single row of double-ended lugs is used.

It is also quite common for other external fittings such as stands, cymbal supports, other drum supports, pedals, and the like to be mounted directly to the drum shell by means of similar attachment lugs.

As is well known, the primary source of sound from a drum arises from vibration of the skins, one as a result of being directly struck by a drum stick or brush, and the other as a result of sympathetic induced vibration. However, it has now be realised that the shell is also capable of resonant vibration, and indeed can contribute significantly to the tone and volume of the drum if it is free to vibrate. It has also been realised that in typical prior art drums, the vibration of the shell is substantially hindered or damped by virtue of the relatively heavy metal anchorage lugs bolted directly to the shell, and by other fittings such as the tensioning screws which are, in turn, secured to those lugs. The resultant alteration in resonant frequency and damping of the vibration of the shell produces a sound which is perceived to be of inferior quality.

It is therefore an object of the present invention to provide a drum which overcomes or at least substantially ameliorates this deficiency of the prior art.

Accordingly, the invention consists in a drum comprising a shell, a pair of skins disposed at opposite ends of the shell, and a substantially free floating tensioning assembly disposed to stretch the skins over the respective ends of the shell, said tensioning assembly comprising respective engagement means adapted to grip the periphery of each skin, a stabilizing ring extending around the shell intermediate the ends thereof, and a plurality of adjustable spaced apart tensioning elements extending intermediate the respective engagement means and the stabilizing ring, said tensioning assembly being disposed to transfer tension directly between the skins substantially independently of the shell and thereby permitting substantially undamped vibration of the shell.

Preferably, each engagement means comprises a loading or tensioning ring clampingly engaging the outer periphery of a respective skin, each loading ring having an internal diameter marginally greater than the external diameter of the drum shell.

In the preferred embodiment, discrete tensioning elements extend from each tensioning ring to the stabilizing ring. It should be appreciated, however, that continuous tensioning elements may simply extend directly between the loading rings via the stabilizing ring.

Preferably also, the stabilizing ring is generally C-shaped in cross section, having upper and lower flanges extending radially inwardly from an intermediate web. The stabilizing ring preferably incorporates a series of threaded fittings spaced circumferentially around each flange, each such fitting being adapted for threaded engagement with a corresponding tensioning element such that rotation of the tensioning elements effects a corresponding relative displacement of the loading ring and thereby varies the tension in the skin.

In an alternative embodiment, the stabilizing ring is disposed within the drum shell and is connected with the tensioning elements by a series of intermediate connecting elements extending through oversized apertures formed in the shell. It should be appreciated, however, that in this embodiment, neither the stabilizing ring, nor the connecting elements make contact with the shell at any point, thereby preserving the free floating nature of the tensioning assembly.

Preferred embodiments of the invention will now be described, by way of example only, with reference to the accompanying drawings in which.

Figure 1:
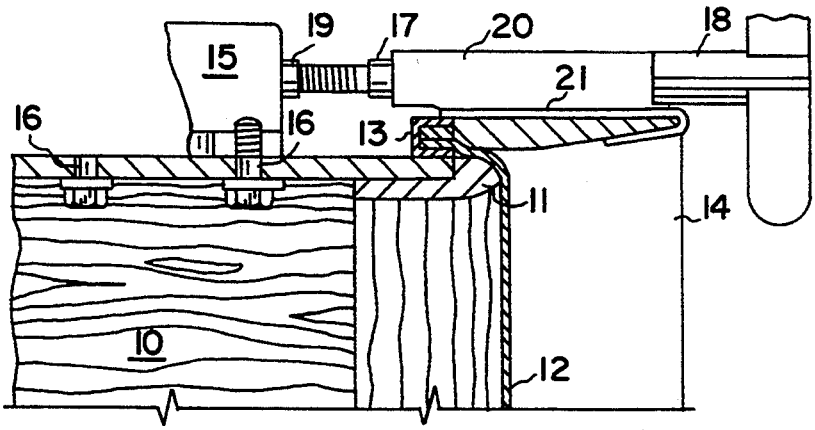
FIG. 1 PRIOR ART
FIG. 1 is a cross-sectional view of the side edge of a drum showing a typical tensioning assembly in accordance with the prior art.

Referring to the drawings, FIG. 1 illustrates a typical bass drum in accordance with the prior art. The drum includes a shell comprising an open ended wooden cylinder 10 having smoothly faired but relatively sharp edge flanges 11. The drum incorporates a pair of diaphragms or skins 12, each of which incorporates a permanently attached peripheral rim in the form of a relatively rigid hoop 13. The drum further includes a pair of tensioning or loading rings 14 each adapted at one edge to bear against a respective hoop 13, and a plurality of abutment sleeves 20 formed with integral hook flanges 21 positioned at equal intervals around the periphery of each loading ring 14. Each ring 14 is loaded against the associated rim 13 to tension the skin by means of a plurality of tensioning elements, each in the form of a bolt 17 having a wing head 18. The shank of each bolt 17 extends through a respective sleeve 20 such that the head 18 of the bolt abuts an adjacent end of the sleeve.

The tension in the skin is transferred via each tensioning bolt 17 to the shell by means of an anchorage block 15. The anchorage blocks 15 are in turn attached directly to the shell by bolts 16 such that the skin is tensioned by engagement of bolts 17 with respective threaded nuts 19. It has been found that these anchorage blocks 15 and other lugs and fittings bolted directly to the drum shell alter the resonant frequencies and damp the vibration of the shell. It is perceived that this adversely affects the sound of the drum.

Figure 2:
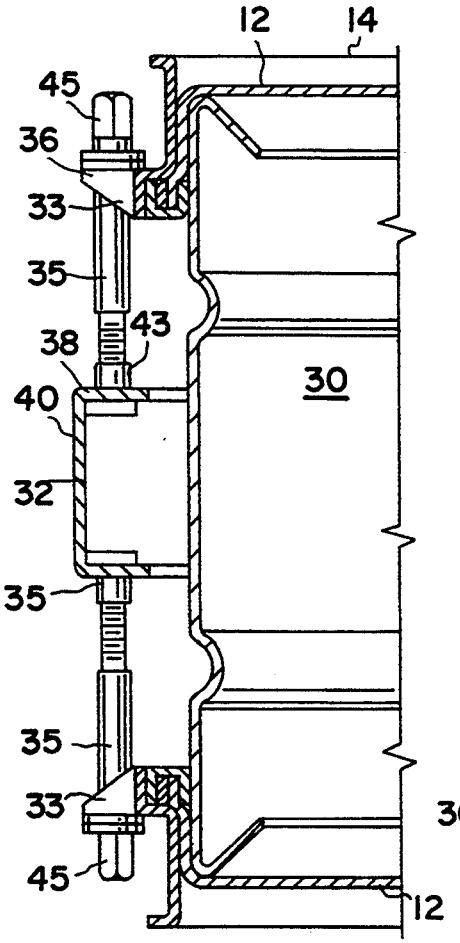
FIG. 2 is a cross-sectional view similar to FIG. 1 showing a drum having a free floating tensioning assembly in accordance with a first embodiment of the present invention.
Figure 3:
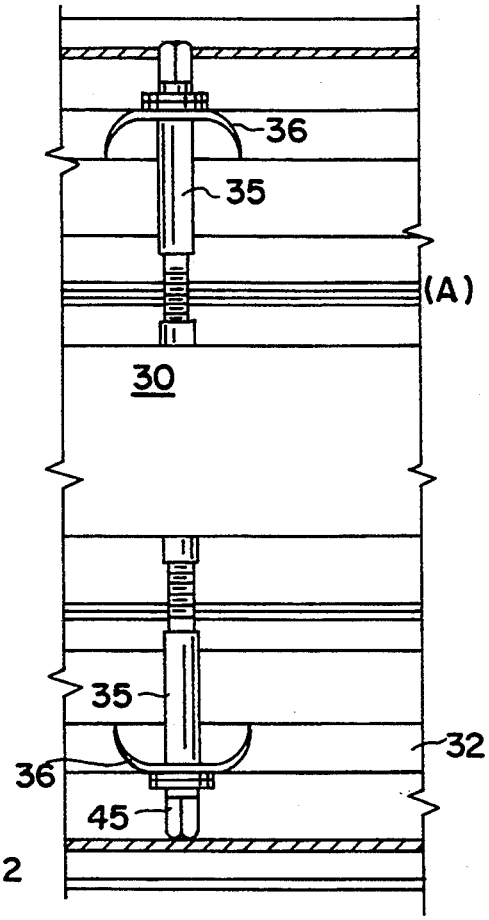
FIG. 3 is a side elevation showing a longitudinal section of the drum of FIG. 2.

FIGS. 2 and 3, in which corresponding features are denoted by corresponding reference numerals, illustrate a snare drum according to a first embodiment of the present invention. It will be appreciated that the shell, skins and loading ring structures are substantially in accordance with the prior art. However, the drum according to the present invention incorporates a substantially free floating tensioning assembly 30 spaced outwardly from the shell. The tensioning assembly comprises a stabilizing ring 32 extending around the shell at mid height, and a plurality of adjustable circumferentially spaced threaded tensioning elements 35. Each tensioning element extends from an outwardly protruding abutment flange 36 associated with a respective loading ring 14 to the central stabilizing ring.

More particularly, the stabilizing ring 32 is generally C-shaped in cross section, having respective upper and lower flanges 38 and 39 extending radially inwardly from an intermediate web portion 40. The ring further incorporates a series of internally threaded fittings 43 spaced circumferentially around each flange. Each such fitting is adapted for threaded engagement with a corresponding one of the tensioning elements 35. In this way, rotation of the tensioning elements by means of a suitable key engageable with square head 45 effects a corresponding displacement of the loading ring which in turn varies the tension in the skins.

Significantly, however, it should be appreciated that unlike prior art drums as exemplified in FIG. 1, the free floating tensioning assembly in accordance with the present invention is disposed to transfer tension directly between the skins, substantially independently of the shell, so that the skins effectively support each other. A consequence of this is that, neglecting frictional effects, both skins must always support approximately the same tension, since there is no facility for transferring unbalanced tension reaction forces to the drum shell.

Figure 4:
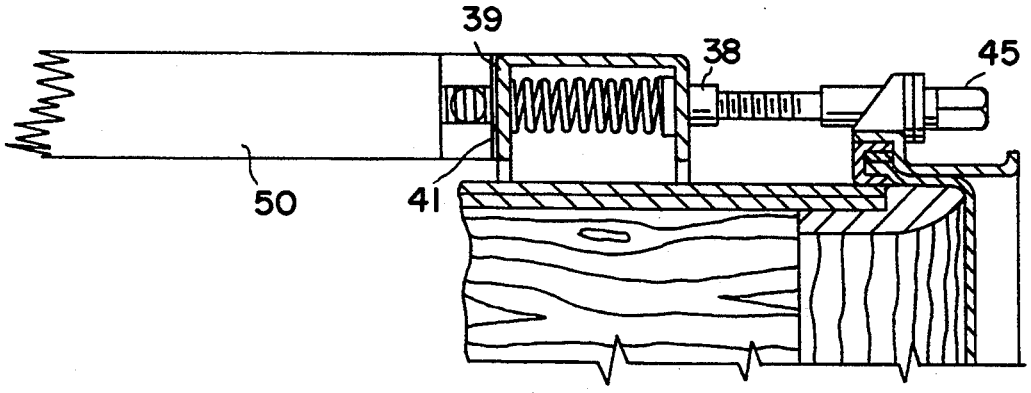
FIG. 4 is a sectional view similar to FIG. 2 showing a second embodiment of the invention.

FIG. 4 is a sectional view similar to FIG. 2 but showing the invention adapted for use with a taller drum. In this embodiment, the stabilizing ring is free floating as in FIG. 2, but is displaced toward the top skin. The only material difference is that a spacing rod 50 is disposed intermediate each lower threaded tensioning element and the bottom flange 39 of the stabilizing ring. Functionally, the tensioning assembly is substantially identical to that shown in FIGS. 2 and 3.

Figure 5:
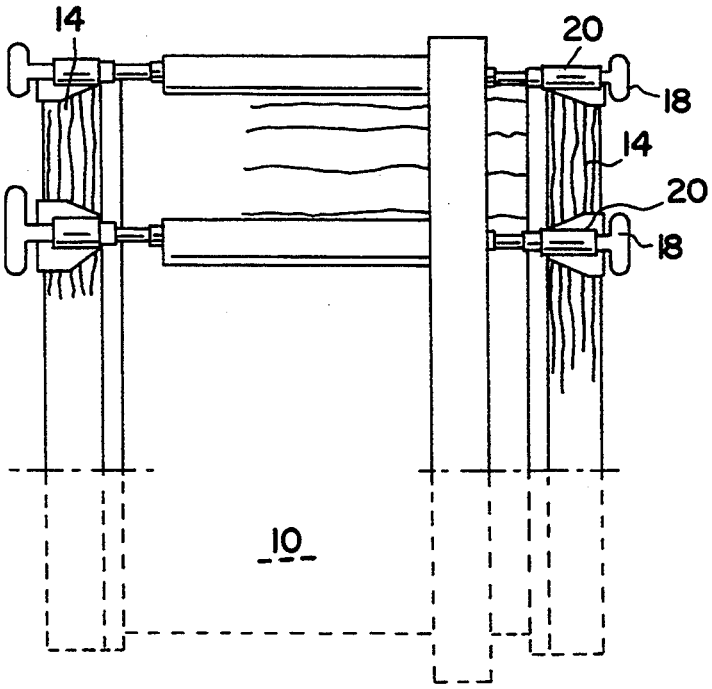
FIG. 5 is a side elevation of a drum similar to that shown in FIG. 4.

FIG. 5 shows an embodiment similar to that shown in FIG. 4, but incorporating a slightly different form of tensioning element and loading ring.

Figure 6:
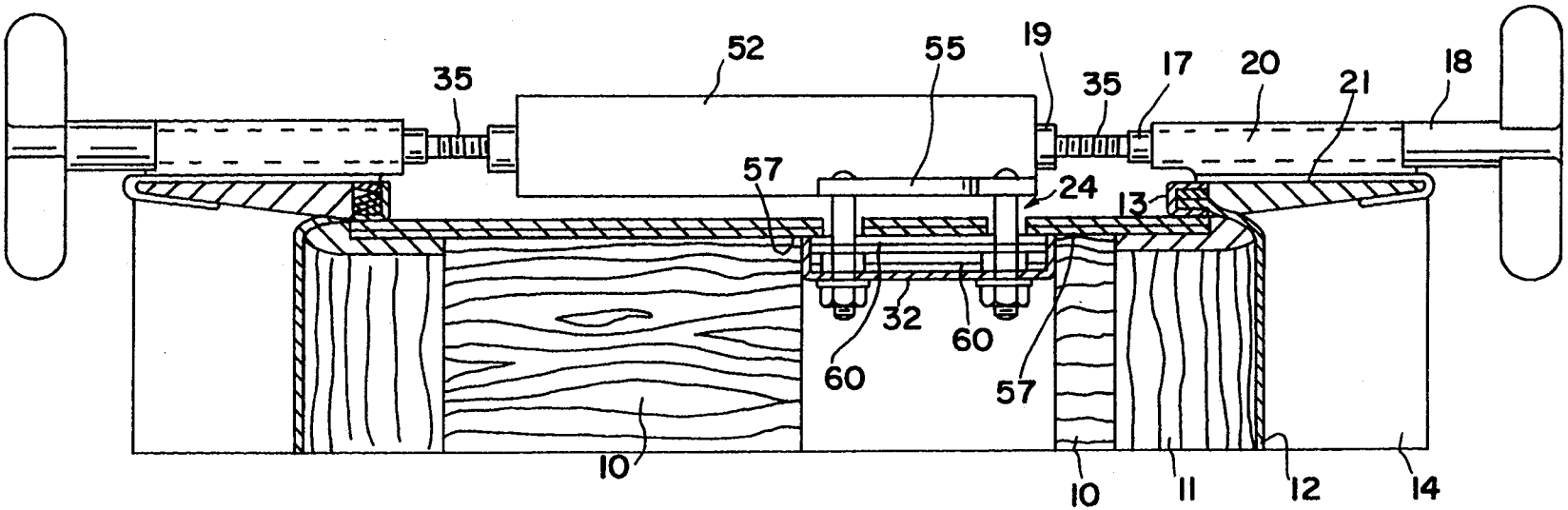
FIG. 6 is a cross-sectional view similar to FIGS. 2 and 4 showing a third embodiment of the invention wherein the stabilizing ring is disposed within the shell.

In the embodiment of FIG. 6, each corresponding pair of tensioning elements 35 is adjustably inter-connected by an intermediate spacer 52, incorporating a pair of outwardly protruding side flanges 55. In this embodiment, the stabilizing ring 32 is actually disposed within the drum shell, and is connected with the spacers 52 by a series of interconnecting nut and bolt assemblies 57. These assemblies extend between the stabilizing ring and the respective flanges 55 on the spacers through oversized apertures 60 formed in the shell. It should be appreciated, however, that in this embodiment neither the stabilizing ring 32, nor the interconnecting nut and bolt assemblies 57 make physical contact with the shell at any point, thereby preserving the free floating nature of the tensioning assembly. Accordingly, the embodiment of FIG. 6 works functionally in substantially the same way as those previously described.

In each case, the skins effectively support one another by transferring tension directly through the free floating tensioning assembly. Obviously, the tension forces are reacted at the peripheral edges 11 of the shell such that the entire shell is loaded in axial compression. However, there is no direct mechanism whereby unbalanced skin tensions can be transferred to the side wall of the shell and in that sense, neglecting frictional effects, the tensioning assembly is able to transfer forces directly between the skins, substantially independently of the drum shell. Cymbal stands, brackets and other fittings may conveniently be attached directly to the stabilizing ring and thereby also isolated from the drum shell.

Advantageously, this feature enables the shell to vibrate freely, without the damping effects imposed by the mounting blocks, lugs, stands, and other fittings which have hitherto been bolted directly to the shell. This represents a significant improvement which will be readily appreciated by those skilled in the art.

A further unexpected benefit has also been discovered. In the prior art, skins are tensioned by bolts 17 evenly spaced around the drum. One skin is tensioned and roughly tuned to approximately the desired pitch and thereafter fine-tuned. Fine-tuning requires tapping of the skin in positions approximately 1 to 2 inches away from each bolt 17, whereby each position on the skin is tuned to the same note. The entire procedure is then repeated for the other skin. The present invention allows simultaneous rough tuning of the skin tension of both skins. Accordingly, once the first skin has been tuned, the second skin only requires fine-tuning. Furthermore, if it is then desired that the pitch of the drum be altered, only the first skin need be adjusted as the second skin will substantially follow suit in a master/-slave arrangement. It will be appreciated that the second skin will maintain its fine-tuning due to the rigidity of the stabilizing ring 32.

Although the invention has been described with reference to specific examples, it will be appreciated by those skilled in the art that the invention may be embodied in many other forms.

I claim:

1. A drum comprising:

a shell;

a pair of skins disposed at opposite ends of said shell; and a substantially free floating tensioning assembly disposed to stretch each of said pair of skins over one of two ends of said shell, said tensioning assembly comprising a pair of engagement means each for gripping a periphery of a respective one of said pair of skins, immediately adjacent said shell a stabilizing ring disposed in spaced apart relation to said shell around said shell intermediate said two ends thereof, and a plurality of adjustable spaced apart tensioning elements connected to said stabilizing ring and said engagement means, each connecting a respective one of said engagement means to said stabilizing ring, whereby said stabilizing ring and said tensioning elements are disposed in spaced apart relation to said shell and supported by said engagement means without direct fixture of said stabilizing ring to said shell such that tension is transferred directly between said skins via said engagement means, tensioning elements and stabilizing ring substantially independently of said shell, thereby permitting substantially undamped vibration of said shell.

2. The drum according to claim 1, wherein said shell has an extended diameter and each said engagement means comprises a loading ring engaging the periphery of a respective one of said pair of skins, each said loading ring having an internal diameter marginally greater than a corresponding external diameter of a portion of said shell adjacent a respective one of said loading rings.

3. The dram according to claim 2, whereto each of said tensioning elements connects a respective one of said loading rings to said stabilizing ring.

4. The drum according to claim 1, wherein said stabilizing ring is generally C-shaped in cross section, having a pair of spaced apart flanges land a circumferential web portion extending intermediate said pair of flanges, each of said flanges extending radially inwardly toward said shell from said circumferential web portion.

5. The drum according to claim 4, wherein the stabilizing ring further comprises a series of threaded fittings spaced around each of said flanges, each of said threaded fittings engaging a respective one of any one said tensioning elements such that rotation of said tensioning elements varies the tension in said skins.

6. The drum according to claim 1, wherein said shell includes a plurality of apertures, wherein said tensioning assembly further includes a plurality of connecting elements, and wherein said stabilizing ring is disposed within said shell, each of said connecting elements extending through a respective one of said apertures without direct contact with the shell and connecting a respective one of said tensioning elements to said stabilizing ring such that tension is transferred directly between said skins via said stabilizing ring substantially independently of said shell, thereby permitting substantially undamped vibration of said shell.

* * * * *